United States Patent [19]

Ueda

[11] Patent Number: 4,962,407

[45] Date of Patent: Oct. 9, 1990

[54] ELECTROPHOTOGRAPHIC COPYING APPARATUS HAVING TONER IMAGE DENSITY MEASURING ARRANGEMENT FOR DETECTING TONER CONCENTRATION

[75] Inventor: Masahide Ueda, Osaka, Japan

[73] Assignee: Minolta Camera Kabushiki Kaisha, Osaka, Japan

[21] Appl. No.: 179,381

[22] Filed: Apr. 8, 1988

[30] Foreign Application Priority Data

Apr. 11, 1987 [JP] Japan ..... 62-89308

[51] Int. Cl.[5] ..... G03G 21/00

[52] U.S. Cl. ..... 355/208; 355/219; 355/246

[58] Field of Search ..... 355/3 DD, 14 CH, 14 D, 355/14 E, 208, 214, 219, 221, 245, 246; 118/688, 689, 691

[56] References Cited

U.S. PATENT DOCUMENTS

| | | | |
|---|---|---|---|
| 4,248,524 | 2/1981 | Takahashi | 355/14 CH X |
| 4,277,162 | 7/1981 | Kasahara et al. | 355/14 R |
| 4,341,461 | 7/1982 | Fantozzi | 355/14 D X |
| 4,348,099 | 7/1982 | Fantozzi | 355/14 D X |
| 4,372,672 | 2/1983 | Pries | 355/14 D X |
| 4,416,535 | 11/1983 | Tottori | 355/14 D |
| 4,419,010 | 12/1983 | Grombone et al. | 355/14 D X |
| 4,432,634 | 2/1984 | Tabuchi | 355/14 D |
| 4,445,772 | 5/1984 | Aoki et al. | 355/14 CH X |
| 4,466,731 | 8/1984 | Champion et al. | 355/14 D |
| 4,502,778 | 3/1985 | Dodge et al. | 355/14 D X |
| 4,508,446 | 4/1985 | Imai | 355/14 D X |
| 4,572,653 | 2/1986 | Ito et al. | 355/14 R |
| 4,639,117 | 1/1987 | Murai et al. | 355/246 |

FOREIGN PATENT DOCUMENTS 55-3704 1/1980 Japan .

*Primary Examiner*—Fred L. Braun

*Attorney, Agent, or Firm*—Burns, Doane, Swecker & Mathis

[57] ABSTRACT

An electrophotographic copying apparatus includes a photosensitive member, a sensitizing charger, a developing unit for developing the electrostatic latent image by a developer incorporating toner and carrier, and a system for compensating toner concentration and charging potential of the photosensitive member surface. The system forms two reference toner images on the photosensitive member surface under different conditions so as to cause the two reference toner images to have different densities and optically measures the densities of the two reference toner images. Toner concentration in the developer can be detected based on the two reference toner image densities. When the toner concentration is less than a specified value, toner is supplied to the developer. Further, the charging potential of the photosensitive member surface is determined based on the toner concentration and the density of the reference toner image formed under the normal image formation condition, and may be corrected in accordance with the determined potential.

16 Claims, 14 Drawing Sheets

T/C
7wt%
ID
1.4
1.2
1.0
0.8
0.6
0.4
0.2
0
0
200
400
600
800V
Vi

T/C=5wt%
T/C=7wt%
T/C=9wt%
BDi
Di
8V
6
4
2
0
200
400
600
800V
Vi

ELECTROPHOTOGRAPHIC COPYING APPARATUS HAVING TONER IMAGE DENSITY MEASURING ARRANGEMENT FOR DETECTING TONER CONCENTRATION

FIELD OF THE INVENTION

The present invention relates to a toner image transferring type of electrophotographic copying machine, and specifically to an apparatus which detects the toner concentration in the developer and the surface potential of a photosensitive member in the developing portion.

BACKGROUND OF THE INVENTION

Toner image transferring type electrophotographic copy machines generally require that a definite toner concentration be maintained for a toner image formed on a photosensitive member in order to regularly maintain a copy image at a definite preferred density. The quantity of toner must therefore be replenished to compensate for the reduction in toner concentration (toner consumption).

On the other hand, the properties of the photosensitive member deteriorate in correspondence with an increase in use. For example, the surface of the photosensitive member may be depleted by contact with the developer and the cleaner blade, and as the thickness of the layer is reduced its chargeability is eroded, thereby reducing the image density. Heretofore, devices have been known, such as that disclosed in Japanese Patent Publication Sho 55-3704, which provide a surface electrometer at the periphery of the photosensitive member to measure the surface potential of said photosensitive member after exposure, and which then compare said measured value to a reference value so as to control the voltage applied to a charging means. However, the electrometers for these devices are expensive, and providing said electrometers in the developing region is structurally impossible. Therefore, the aforesaid devices do not necessarily measure the surface potential in the developing region of the photosensitive member, and have the further disadvantage in that they effectively reduce the image density when the chargeability of the photosensitive member is greatly eroded.

SUMMARY OF THE INVENTION

Accordingly, a main object of the present invention is to provide an electrophotographic copying apparatus which is excellent in supplying toner in response to depletion of the toner in the developer.

A further object of the present invention is to provide an electrophotographic copying apparatus is capable of detecting the surface potential of the photosensitive member without the use of an electrometer.

An even further object of the present invention is to provide an electrophotographic copying apparatus which detects the surface potential in the developing portion of the photosensitive member without the use of an electrometer, and which set image formation conditions so as to regularly obtain excellent images These objects of the present invention are accomplished by providing an electrophotographic copying apparatus comprising a photosensitive member, charging means for charging the surface of said photosensitive member, exposure means for exposing the charged surface of said photosensitive member by light so as to forming an electric latent image thereon, developing means for developing the electrostatic latent image by a developer incorporating toner and carrier, means for forming two reference toner images on the surface of said photosensitive member under different conditions so as to cause the two reference toner images to have different densities, measuring means for optically measuring the densities of the two reference toner images formed on the surface of said photosensitive member, detecting means for detecting toner concentration in the developer based on the two reference toner image densities measured by said measuring means, and supply means for supplying toner to the developer when the toner concentration detected by said detecting means is less than a specified value.

The electrophotographic copying apparatus of the present invention is further characterized by comprising a photosensitive member, charging means for charging the surface of said photosensitive member, exposure means for exposing the charged surface of said photosensitive member by light so as to form an electric latent image thereon, developing means for developing the electrostatic latent image by a developer incorporating toner and carrier, means for forming a first reference toner image on the surface of said photosensitive member by operating said charging means means under normal image formation condition and for forming a second reference toner image on the surface of said photosensitive member by operating said charging means under abnormal image formation condition, measuring means for optically measuring the densities of the first and second reference toner images formed on the surface of said photosensitive member, detecting means for detecting toner concentration in the developer based on the first and second reference toner image densities measured by said measuring means, means for determining the charging potential of the photosensitive member surface, in the normal image formation under which the first reference toner image is formed, based on the toner concentration in the developer detected by said detecting means and the first reference toner image density measured by said measuring means, and means for correcting the normal image formation condition in accordance with the surface potential determined by said determining means.

BRIEF DESCRIPTION OF THE DRAWINGS

These and other objects or features of the present invention will become apparent from the following description of the preferred embodiments thereof taken in conjunction with the accompanying drawings.

FIGS. *7a* to *7d* are descriptive diagrams showing the formation of the reference electrostatic latent image and reference toner image.

Figure 1:
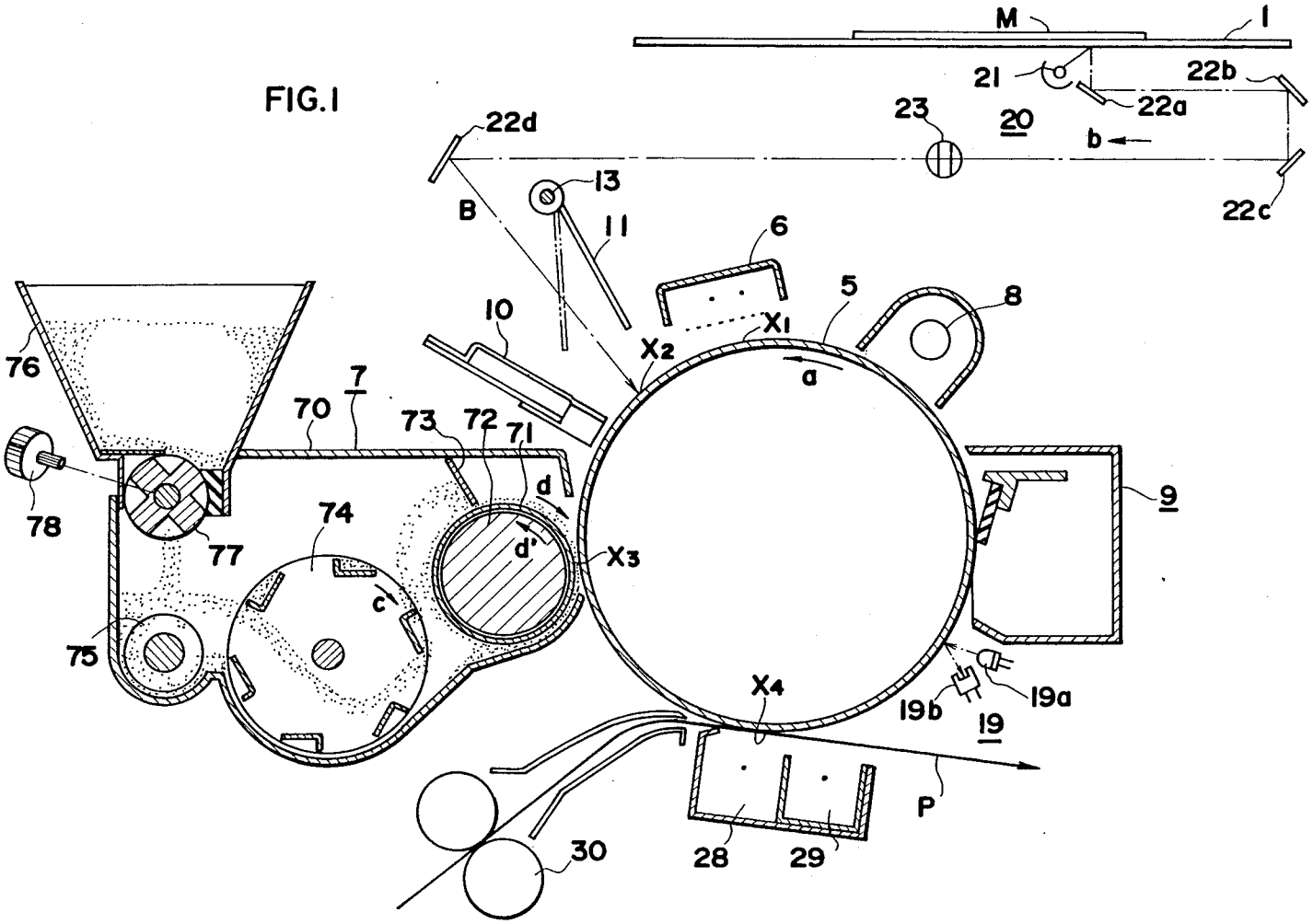
FIG. 1 is a brief structural view of an electrophotographic copying apparatus embodying the present invention.
Figure 8:
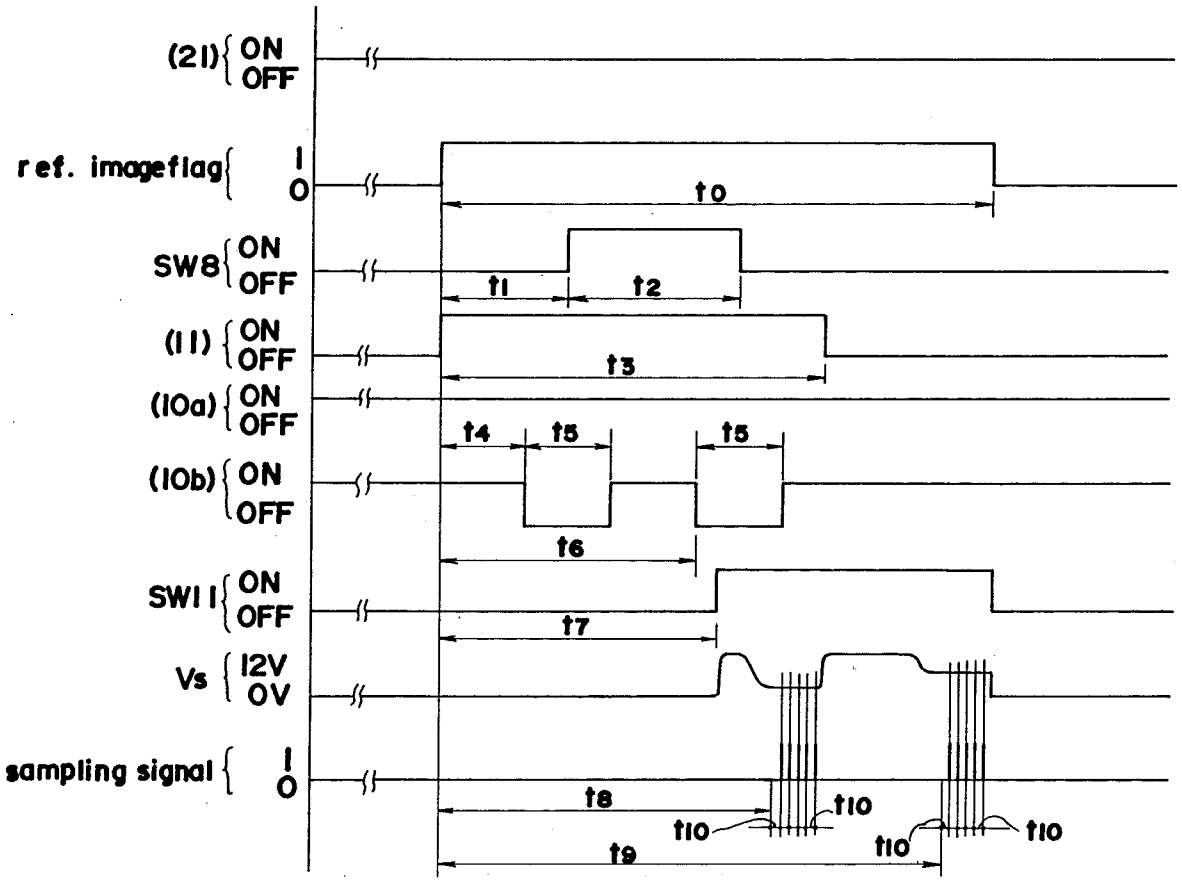

FIG. 8 is a time chart showing the controls of the electrophotographic copying apparatus of FIG. 1.

Figure 9:
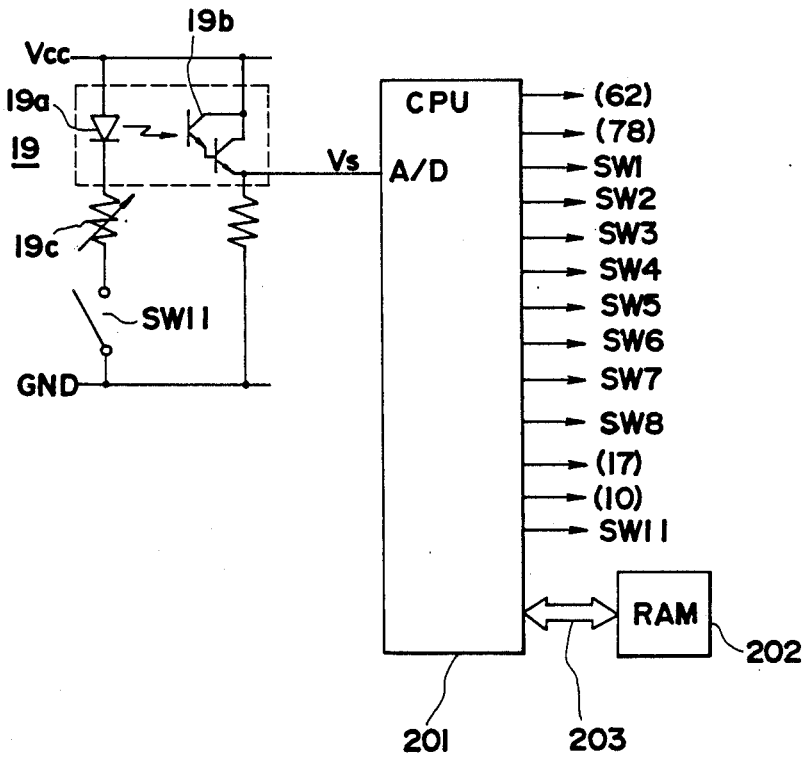

FIG. 9 is a control circuit diagram for the electrophotographic copying apparatus of FIG. 1.

Figure 10:
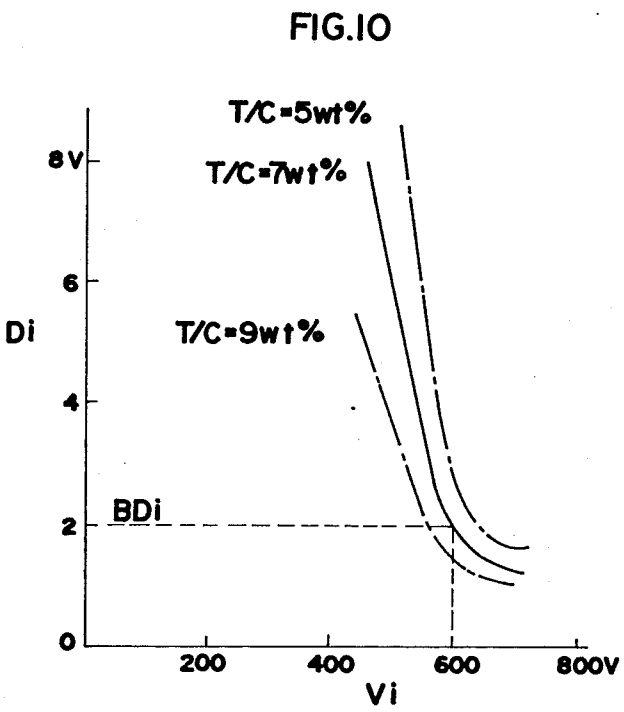

FIG. 10 is a graph of the output voltage from the photosensor relative to the surface potential of the reference electrostatic latent image.

Figure 11:
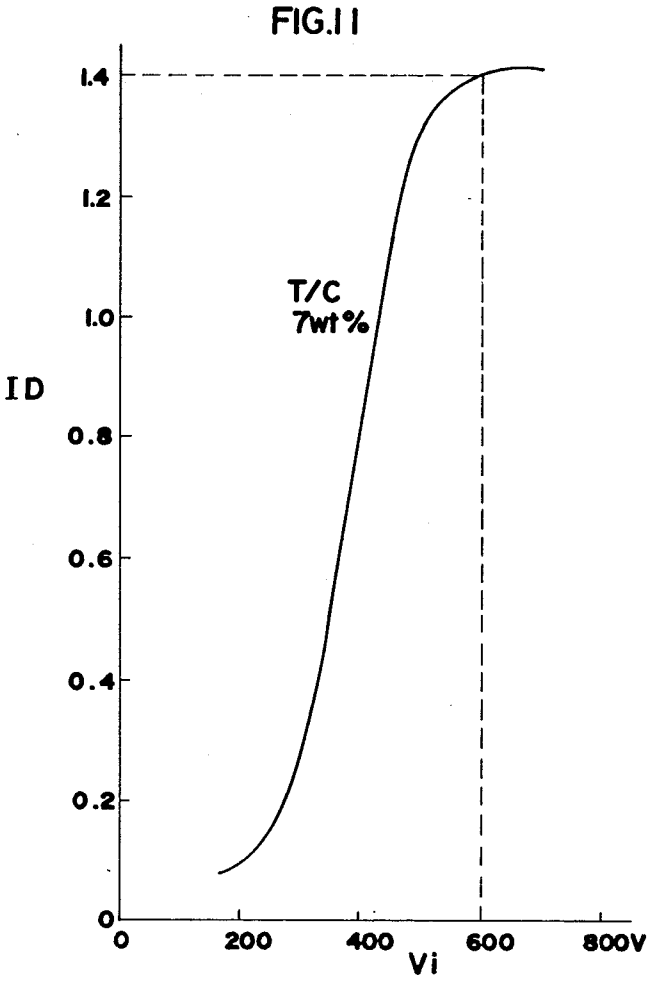

FIG. 11 is a graph of the image density relative to the electrostatic latent image surface potential.

FIGS. 12, 13A, 13B, 14A, 14B and 15 are flow charts showing the control sequence for the control circuit of FIG. 9.

In the following description, like parts are designated by like reference numbers throughout the several drawings

DETAILED DESCRIPTION OF THE PREFERRED EMBODIMENT

A single example of the electrophotographic copying apparatus of the present invention is described hereinafter with reference to the accompanying drawings

Construction and Operation of the Copying Apparatus

Photosensitive drum 5 is rotated in the direction indicated by arrow "a" in FIG. 1 at a uniform circumferential speed V, and the image on the original document M disposed upon the document glass platen 1 is exposed by the exposure portion X2 through optical system 20, whereby an electrostatic latent image is formed on said photosensitive drum 5 which corresponds to the image on the original document.

Optical system 20 comprises an exposure lamp 21, mirrors 22*a* to 22*d*, and projecting lens 23. During image exposure, the exposure lamp 21 and mirror 22*a* travel in the direction of arrow "b" at a speed of V/m (where m = copy magnification), and mirrors 22*b* and 22*c* respectively travel at a speed of V/2m.

Around the circumference of photosensitive drum 5 are provided a sensitizing charger 6 for charging the surface thereof, unexposed areas eraser 10 for erasing the image interval charge on other than the latent image of the original document, developing unit 7 for adhering toner to the electrostatic latent image formed by the optical system 20 so as to develop said image, transfer charger 28 for transferring said toner image onto copy paper P fed thereto from the resist roller 30, separation charger 29 for separating said copy paper P from the photosensitive drum 5, cleaner unit 9 for removing residual toner adhering to said photosensitive drum 5, and main eraser 8 for erasing the residual charge from said photosensitive drum 5.

Developing Unit Construction and Operation

Developing unit 7 uses a developer comprising a mixture of magnetic carriers and insulated toner to perform so-called standard development wherein toner adheres to a latent image (charged portion) which transits a developing region X3 by means of a commonly known magnetic brush method.

Within the developer tank 70 are arranged a developing sleeve 71 which houses developing roller 72, brush-height regulating member 73, bucket roller 74, and screw roller 75. The developer is attracted to the exterior surface of developing sleeve 71 by the magnetic force provided by magnetic roller 72 as said developer is delivered thereto by the rotation of the bucket roller 74 in the direction of arrow "c," whereupon said developer is transported to the developing region X3 by means of the rotation of the developing sleeve 71 in the direction of arrow "d" or the rotation of the magnetic roller 72 in the direction of arrow "d'".

On the other hand, to the underside of the toner tank 76 provided at the top of developing tank 70 is arranged a toner replenishment roller 77 which is rotationally actuated by the replenishment motor 78. The toner within the toner tank 76 is supplied onto the screw roller 75 by the rotation of said replenishment roller 77, and is mixed with the developer already present by the agitative action imparted by the rotation of the roller 75, and is thence transported to bucket roller 74. The toner is triboelectrically charged by the agitated mixing with the magnetic carrier.

Reference Electrostatic Latent Image Formation and Reference Toner Image Density Measurement In the present embodiment, the concentration of the toner within the developer held in the developer tank 70 is detected based on the difference in densities of two reference toner images L2*a* and L2*b* described hereinafter, and the toner replenishment is controlled so as to maintain a constant uniform toner concentration within the developer supplied for the developing process. At the same time, the output value of the sensitizing charger 6 is controlled and corrected based on the measured density value of the first reference toner image L2*a*.

Processing prior to the formation of the two reference toner images L2*a* and L2*b* consists of the creation of two reference electrostatic latent images L1*a* and L1*b* having different surface potentials. In the present embodiment, the first reference latent image L1*a* is formed under normal original image formation conditions. More specifically, the surface potential of said first reference latent image L1*a* is identical to the surface potential during normal original image formation, i.e. 600 V, and the surface potential of the second reference latent image L1*b* is 100 V less than the aforesaid at 500 V. The change in the surface potential is obtained by changing the output value of the sensitizing charger 6.

Figure 2:
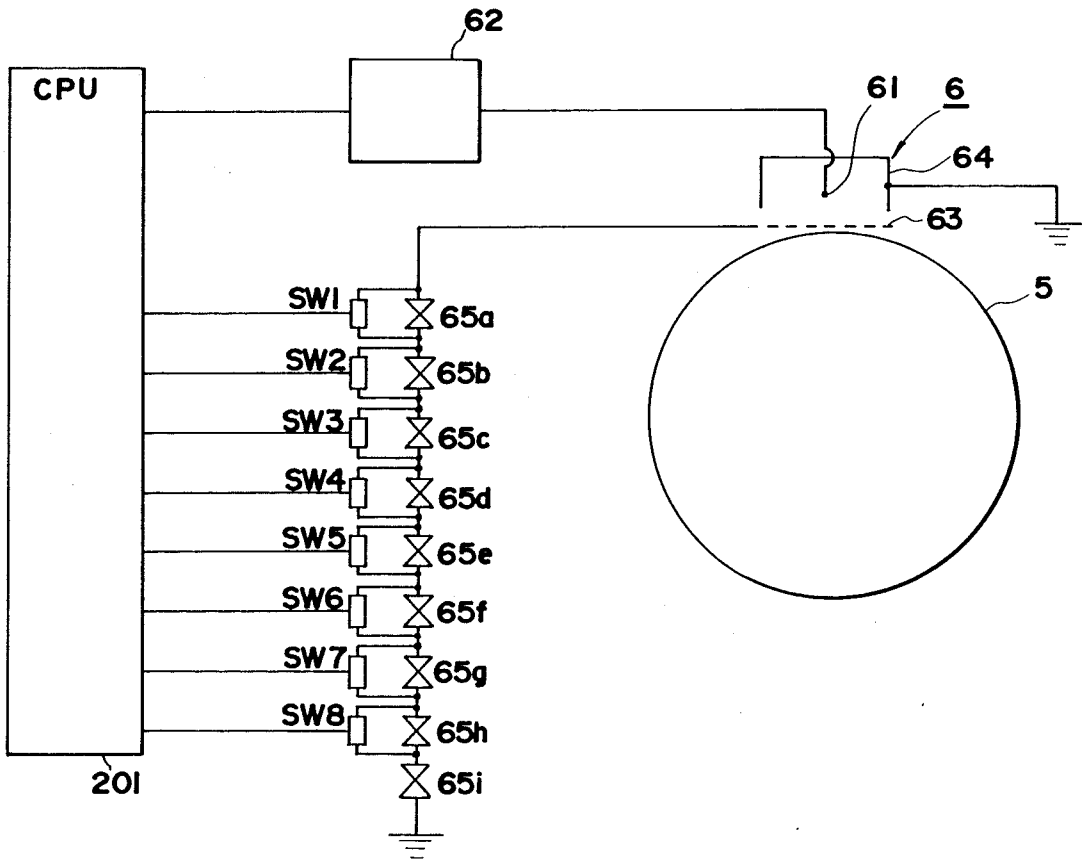
FIG. 2 is a circuit diagram showing the control circuit of the sensitizing charger.

The construction and control circuit for the sensitizing charger 6 is described hereinafter with reference to FIG. 2.

The sensitizing charger 6 is a scorotron-type charger comprising a charging wire 61, grounded stabilizer 64, and a mesh-like grid 63 interposed between said charging wire 61 and photosensitive drum 5. Charging wire 61 is connected to the CPU 201 via a high-voltage transformer 62, and receives output ON/OFF and output voltage (set values) commands from said CPU 201. Grid mesh 63 is connected in series to varistors 65*a* to 65*i*. Varistors 65*a* to 65*h* are connected to CPU 201 by short-circuit switches SW1 to SW8 respectively. When each short-circuit switch SW1 to SW8 is switched ON via a signal from CPU 201, circuits bypassing each varistor 65*a* to 65*h* are selected. When short-circuit switches SW1 to SW8 are switched OFF, a charge discharged by charging wire 61 is applied to varistors 65*a* to 65*h* and varistor 65*i* which are stored so as to maintain a uniform potential on grid mesh 63, while the excess charge is dissipated to a ground as current Therefore, numreous variations are obtained for the electric potential of the grid mesh 63 which is identical with the sum of the rated voltage of the varistor 65*i* and that of each varistor 65*a*–65*h* of which each of short-circuit switches SW1SW8 are switched OFF.

Thus, the amount of charge supplied from the charging wire 61 to the surface of the photosensitive drum 5 can be controlled by changing the electric potential GVi of grid mesh 63, with the effect that the surface potential of said photosensitive drum 5 is thereby controlled.

During formation of the original document image, the grid potential GVi is set so that the potential reaching the developing region Xl of the photosensitive drum surface is maintained at 600 V, while anticipating the effect of dark decay. However, the charge will be considered to be 600 V to simplify the following description. Then, the first electrostatic latent image L1*a* having a surface potential of 600 V similar to the potential during the formation of the original document image is formed, and the second electrostatic latent image L1*b* is formed so as to have a surface potential of 500 V which is 100V less than the former. More specifically, with the rated voltage of the aforesaid varistor 65*h* being 100 V, the grid potential GVi is reduced by 100 V by switching ON the short-circuit switch SW8 each time the second reference latent image is formed.

Further, zener diodes can be used in place of the varistors 65*a* to 65*h*.

Explanations of the formation of the reference latent images L1*a* and L1*b* follow. These reference electrostatic latent images L1*a* and L1*b* are formed by unexposed areas eraser 10 and shutter 11 on an image interval portion which is not transferred onto paper P.

Figure 3:
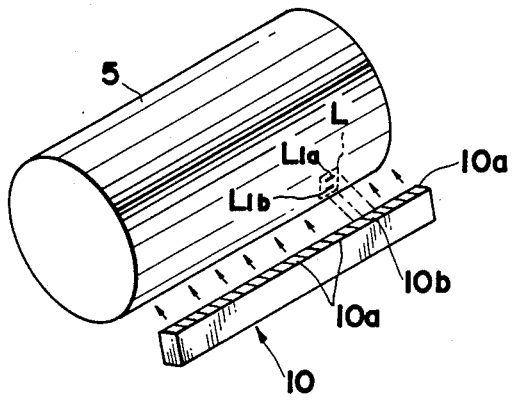
FIGS. 3 and 6 are perspective views showing the formation of the reference electrostatic latent image.
Figure 4:
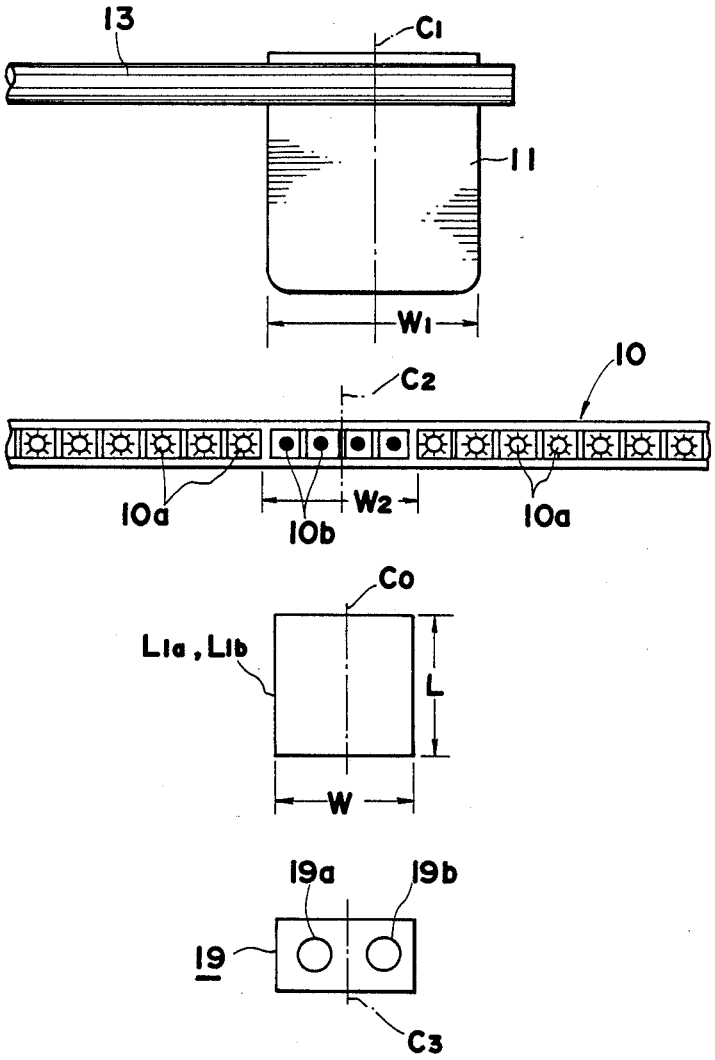
FIG. 4 is a descriptive diagram showing the relational positioning of the shutter, unexposed areas eraser, photosensor and reference electrostatic latent image.

The unexposed area eraser 10 is disposed in the foreground of the developing portion in the direction of rotating of the photosensitive drum 5 and faced with the surface of the photosensitive drum 5 for the purpose of removing the charge on the image interval portion. That is to say, sensitizing charger 6 necessarily operates on that portion of photosensitive drum 5 which is outside the original document portion so as to allow uniform charging of the region wherein the original document latent image is formed, and which usually operates continuously during high-speed continuous copying operations given the time required for its operation. A charge is therefore imparted to that region of photosensitive drum 5 which is outside the region of the original document latent image, and if left in that state toner is unnecessarily consumed during the copying process as the region on the drum transits the developing region X3. Accordingly, the unexposed areas eraser 10 removes the charge from the region outside the original document latent image region before said region transits the developing region X3. The unexposed areas eraser 10 comprises a plurality of individual light-emitting diodes (hereinafter referred to as LED) 10*a* and 10*b* arrayed in the axial direction of photosensitive drum 5, as shown in FIGS. 3 and 4.

Figure 5:
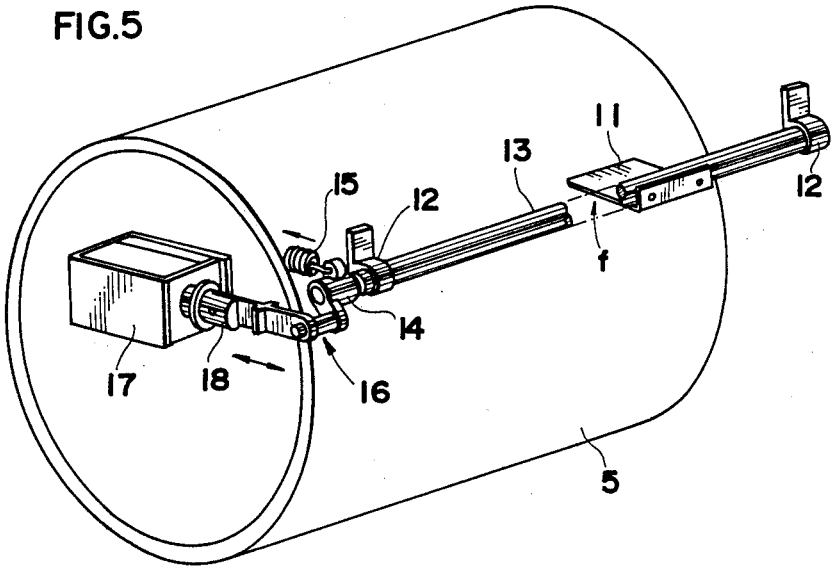
FIG. 5 is a perspective view of the shutter actuating portion.
Figure 6:
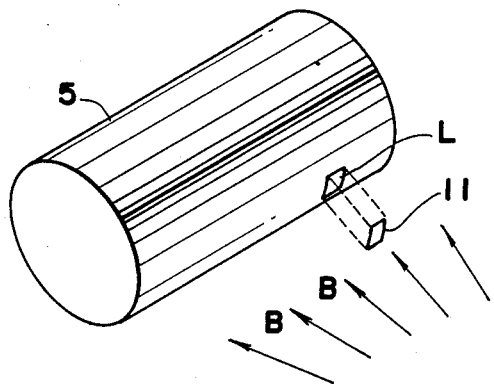

On the other hand, shutter 11 is so disposed as to allow it to be switched between an interrupt position which interrupts the projected light B and a non-interrupt position which does not interrupt said light when light B is projected along the optical path to the photosensitive drum 5, as shown in FIG. 1. As shown in FIG. 5, the shutter 11 is fixedly mounted to a portion of rotatable shaft 13 which is supported by bearing 12, said shutter 11 having force applied thereto in the direction of arrow "f" by spring 15 through a collar 14 fixedly mounted to one end of said rotatable shaft 13, and said shutter 11 being removed from the optical path when in the force-applied position. The collar 14 is connected to a plunger 18 of solenoid 17 via a linkage mechanism 16. When the plunger 18 is withdrawn against the applied force of spring 15 via a current supplied to the solenoid 17, shutter 11 is rotated in a reverse direction indicated by arrow "f" so as to interrupt the projected light B. When shutter 11 is actuated to interrupt the projected light B, the charge on the portion of photosensitive drum 5 corresponding to the position of shutter 11 operation is not removed and so remains, whereby a latent image L is formed in response to the state of said shutter 11, as shown in FIG. 6.

Thus, the formed latent image L is positioned in the unexposed areas portion and the charge imparted thereto is removed by the unexposed areas eraser 10 each time it transits the unexposed areas region 10 The present embodiment is constructed so as to switch OFF the LEDs 10*b* in the portion region corresponding to the aforesaid latent image L in standardized timing to prevent the removal of the charge in that region. The unexposed areas eraser 10 is arranged in extreme proximity to the surface of the photosensitive drum 5, and the charge on the photosensitive drum 5 remains without erasure in a zone width virtually equal to a zone width corresponding to the number of LEDs which were switched OFF. Further, during the time that the switched OFF LEDs 10*b* remain OFF, the charge remains without erasure for the distance the photosensitive drum 5 rotates Thus, the portion which remains charged is that portion bearing the reference latent images L1*a* and L1*b* (see FIG. 3)

Figure 7A:
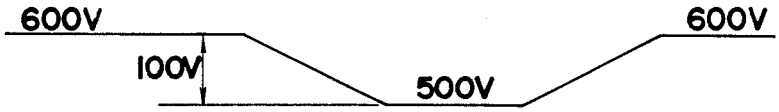

Each time the reference latent image L1*a* region passes by the charging portion Xl, the grid mesh potential GVi which is maintained at 600 V imparts a surface potential of 600 V to said first reference latent image L1*a*. On the other hand, each time the second reference latent image L1*b* region passes by the charging portion Xl, the grid mesh potential GVi is switched to 500 V by the short-circuit switch SW8 which is switched ON, thereby imparting a surface potential of 500 V to the second reference latent image L1*b* (see FIG. 7A)

The thus obtained first and second reference latent images L1*a* and L1*b* having a 100 V potential differential transit the developing region X3 in company with the rotation of photosensitive drum 5, where said reference images are developed by the adhesion of toner thereto via developing unit 7, and thereby producing the reference toner images L2*a* and L2*b* respectively.

Subsequently, the photosensitive drum 5 transits the transfer region X4, but because the reference toner images L2*a* and L2*b* are formed in the unexposed areas, said reference images are not transferred to the copy paper P and remain on the photosensitive drum 5.

Figure 7B:
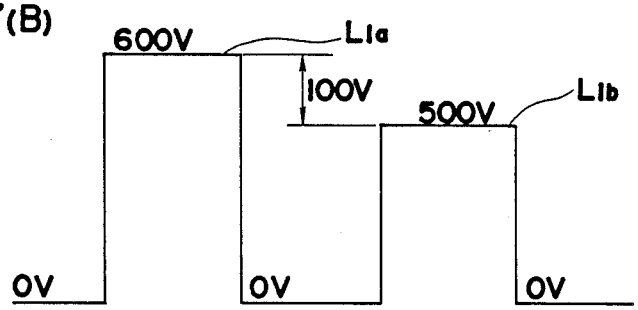
Figure 7C:
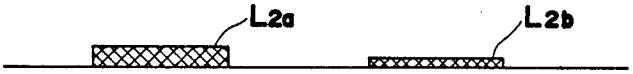

The surface potential of the first reference latent image L1*a* is 600 V, while that of the second reference latent image L1*b* is 500 V, as previously described (see FIG. 7B).. Accordingly, the first reference toner image L2*a* obtained by developing the appropriate latent image has a heavy density, whereas the density of the second reference toner image L2*b* is light (see FIG. 7C). In the present embodiment, the toner concentration in the developer is detected based on the difference in reference toner image densities by optically measuring the densities of said reference toner images by means of a reflecting-type photosensor 19. Further, since the density of the first reference toner image directly reflects the surface potential during normal formation of the original document image, the surface potential of the developing region X3 of photosensitive drum 5 is detected from the measured values for the density of the first reference toner image L2*a* and the concurrent toner concentration, thereby allowing correction control of said surface potential to be made.

Figure 7D:
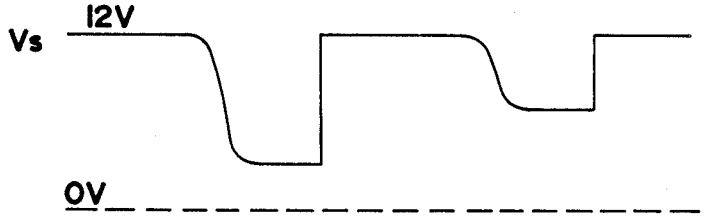

The measurement of the densities of the reference toner images L2*a* and L2*b* are accomplished by means of the reflecting-type photosensor 19. As shown in FIG. 1, the photosensor 19 comprises a light-emitter 19*a* and a photoreceptor 19*b* and is interposed between the transfer region X4 and the cleaning unit 9 and faces the surface of photosensitive drum 5 as it travels between said region and unit, and is so arranged as to correspond with the reference toner images L2*a* and L2*b*. AccordinglY, the photosensor 19 can measure the densities of said reference toner images L2*a* and L2*b*. When the density of the reference toner image is too heavy, the quantity of reflected light is reduced and the output voltage Vs from the photoreceptor 19*b* is decreased When the density of the reference image is too light, the quantity of reflected light higher and the output voltage Vs from photoreceptor 19*b* is increased (see FIG. 7D)

FIG. 4 shows the positional relationships of the aforesaid shutter 11, unexposed areas eraser 10, photosensor 19 and reference latent images L1*a* and L1*b* formed on the photosensitive drum 5 in the axial direction of said drum 5. FIG. 8 shows the operation of each component As indicated in FIG. 4, the shutter 11 center Cl and the reference latent image centers C0 do not coincide. This lack of coincidence occurs because the region in which the reference latent images L1*a* and L1*b* are formed is eccentric to the center position in the axial direction of photosensitive drum 5, i.e., is caused by the positional separation of the shutter 11 from the surface of the photosensitive drum 5. Thus, because the projected light B is enlarged in the longitudinal direction of photosensitive drum 5, the shutter 11 interrupt position is shifted in the axial direction of said drum 5. On the other hand, because the unexposed areas eraser 10 is disposed in extreme proximity to the surface of the photosensitive drum 5, the center C2 of the switched OFF LED 10*b* region used to form the reference latent images L1*a* and L1*b* and the center C0 of the reference latent images L1*a* and L1*b* coincide. The width W2 of the switched OFF LED 10*b* region becomes the width W of the reference latent images L1*a* and L1*b* in the longitudinal direction of the photosensitive drum 5. In addition, the center C3 of the photosensor 19 also coincides with the center C0 of the reference latent images L1*a* and L1*b*.

The time chart shown in FIG. 8 corresponds to the unexposed areas portion. In the initial state, the exposure lamp 21 and all LEDs 10*a* of the unexposed areas eraser 10 are ON. The exposure lamp 21 remains ON even in the unexposed areas portion to stabilize the exposure during the document scanning and to increase the copYing speed. Then, to form the reference latent images L1*a* and L1*b*, the shutter 11 is actuated for a set time T3 by the solenoid 17 so as to interrupt the projected light B.

The short-circuit switch SW8 switches OFF for time t1 required for the first reference latent image L1*a* portion to transit the charging region Xl, and switches ON only for time t2 required for the second reference latent image L1*b* portion to pass, thereby creating a difference in potential of 100 V between the two reference latent images L1*a* and L1*b*.

The LED 10*b* of the unexposed areas eraser 10 is OFF only during a set time t5 after a time t4 during which the first reference image portion arrives at the eraser 10 position, and is again switched OFF a set time t5 after a time t6 during which the first half of the reference imaqe portion passes. The reference latent images L1*a* and L1*b* are formed by switching OFF the LED 10*b*, and the length L of the reference images L1*a* and L1*b* in the direction of rotation of photosensitive drum 5 are determined by the aforesaid OFF time t5, as shown in FIG. 4. 11

As shown in FIGS. 4 and 8, the width W1 of the shutter relative to the width W of the reference images L1*a* and L1*b* are set so as to be greater than the width W2 of the switched OFF LED portion, and the shutter 11 operation time t3 is set longer than two of the switched OFF time t5 of LED 10*b*. Thus, reference latent images L1*a* and L1*b* are normally formed at a fixed size on photosensitive drum 5.

Detailed discussion of the reference toner image density measurements by the aforesaid photosensor 19 follows hereinafter.

As shown in FIG. 9, the light emitter 19*a* is connected to switch SW11 through variable resistor 19*c*, and the output voltage Vs of photoreceptor 19*b* is input to the A/D port of CPU 201. The input sensor output voltage Vs is converted to a digital signal and stored, through data base 203, in random access memory 202 (hereinafter referred to as RAM) provided with a battery backup, from which it is fetched by data processing when suitable.

Switch SW11 is switched ON after time t7 elapses following actuation of the previously described shutter 11, i.e., immediately prior to the arrival of the first reference toner image L2*a* at the photosensor 19, so as to provide the measurement of reflected light, as shown in FIG. 8. At this time the output voltage Vs of the photoreceptor 19*b* is 12 V in the present embodiment. Then, although the reference toner images pass beyond the position opposite the photosensor 19, the output voltage Vs describes a downturning curve due to the response delay of photoreceptor 19*b* and reaches the region of stability in times t8 and t9. In this stable region, the output voltage Vs is read five times in succession in cycle time t10, then averaged and the derived value is designated feedback data Dia and Dib. Thereafter, switch SW11 is switched OFF, and the light emitter 19*a* is turned OFF.

The detection data Di obtained from the averaged output voltage Vs of photosensor 19, i.e., the detection data Dia for the first reference toner image L2*a* and the detection data Dib for the second reference toner image L2*b*, is determined via the surface potentials Vi of the reference latent images L1*a* and L1*b* in the developing region X3 and the toner concentration T/C in the developer. The relationships of these items are shown in the graph in FIG. 10.

The photosensor output voltage Vs=Di exhibits lower values as the toner concentration T/C increases, and the slope of the curve also decreases. This condition means that developing efficiency is superior when the developer toner concentration T/C is highest, with adequate toner adhesion even at low surface potential Vi, and the output voltage Vs is reduced. Further, since the output voltage Vs saturation point is the same, the slope decreases in the vicinity of surface potentials Vi between 500 and 600 V.

Accordingly, at a specified surface potential Vi, the photosensor 19 output voltage data Di contains a different value, and the slope of the characteristics curve for the toner concentration T/C varies.

At this point the difference in output for the photosensor measured data Dia and Dib ($\Delta Di = |Dia - Dib|$) relative to the first and second reference toner images L2*a* and L2*b* is calculated. Since the surface potential differential ΔVi of the first and second reference toner images L2*a* and L2*b* is normally set at a uniform 100 V, the slope of the characteristic curve shown in FIG. 10 can be determined from said output differential ΔDi. In the present embodiment, the output differential ΔDi for the standard toner concentration T/C of 7% by weight is 3.7 V.

When $\Delta Di > Di(7\ wt\%)$, a command for toner resupply is issued.

On the other hand, the graph in FIG. 11 shows the relationship of the image density ID to the surface potential Vi of the electrostatic latent image on the photosensitive member after developing and image transfer when the toner concentration T/C is 7% by weight. The image density ID suddenly rises in the region of latent image surface potential of 200 to 500 V, the slope flattens somewhat when the potential exceeds 500 V, and a set density value of 1.4 V is maintained in the vicinity of 600 V.

In the present embodiment, the surface potential Vi of the first reference latent image L1*a* which is designated the control reference is set at 600 V to obtain a stable image density ID of 1.4 V.

When the latent image surface potential Vi is near 600 V, the image density ID is virtually saturated and achieves a stable value, but the voltage Di used as the detection data in FIG. 10 still has slope and is not saturated. The reason is that the reference toner image which is the object of density measurement by photosensor 19 is an image formed on the photosensitive drum 5, in contrast to the image density ID which is the measured value of a toner image that has been transferred to copy paper P and fixed thereto. The latter image is fused and depressed which raises the image density ID when even a small quantity of adherent toner is present.

As clearly shown in FIG. 10, if the toner concentration T/C is determined, the reference latent image surface potential Vi can be found from the sensor output voltage Di. For example, when the toner concentration is 7% by weight, the reference image surface potential will be 600 $\overline{V}$ if the sensor output voltage is 2 $\overline{V}$. The correction value for the photosensitive drum 5 surface potential in the developing region X3 can be determined by comparing the surface potential of the thus obtained surface potential of the first reference image L1*a* and the 600 V standard surface potential. The aforesaid correction value is input to the sensitizing charger 6 output as feedback in the present embodiment, thereby correcting for reductions in image density ID caused by deterioration in chargeability and increase in dark decay due to layer thickness wear of the photosensitive member.

In the copying apparatus of the present invention, the amount of light emitted by light emitter 19*a* of photosensor 19 can be adjusted by the operation of a variable resistor 19*c* which is set at the time of setup or of factory shipment When said adjustment is made, the charged surface potential Vi of the sensitizing charger 6 is verified as being 600 V and the toner concentration T/C is verified as being 7% by weight; adjustment is made by performing copy operations. Adjustment may be made to photosensor 19 alone using a simulation pattern by adjusting said photosensor so that the sensor output voltage Di is 2 V at 600 V surface potential when the toner concentration T/C is 7% by weight.

Control Procedure

The control of the previously described operations by CPU 201 processing is hereinafter described with reference to the flow chart of FIG. 12.

Figure 12:
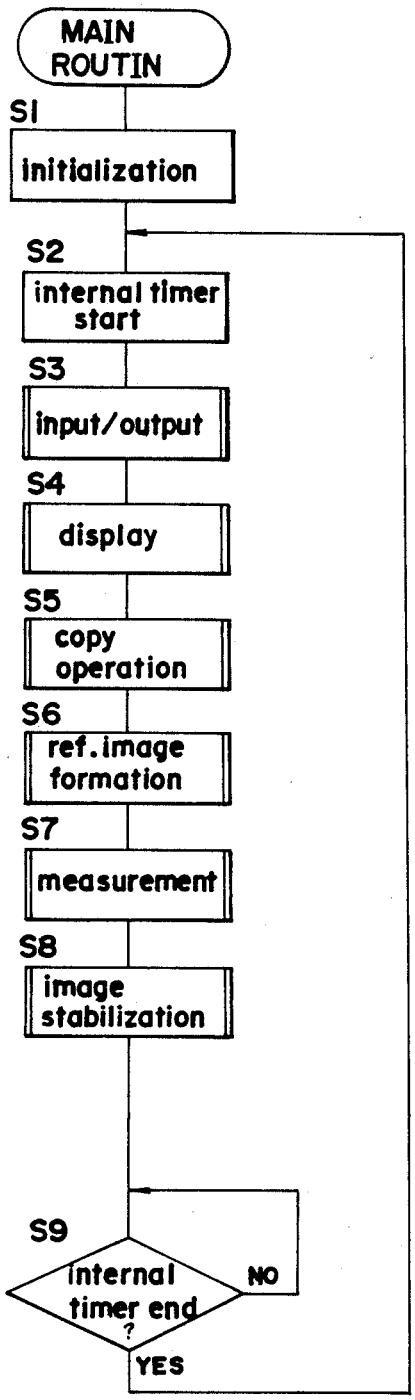

FIG. 12 shows the main routine of CPU 201.

When CPU 201 is reset and the program started, in step S1, the program is initialized to clear the RAM 202, initialize each type register and set each device to the initialization mode. Then, in step S2, the internal timer is started. Since the internal timer determines the time required to run the main routine, its value is set in the previous initialization step S1.

Next, in steps S3 to S8, each subroutine is sequentially called, and when all calls are completed, the completion of the internal timer is awaited in step S9, then the program returns to step S2 each.

The step S3 subroutine reads the input signals from switch and outputs the required data to every part of the copy apparatus The step S4 subroutine displays the processing information on an operation panel not shown in the drawings The step S5 subroutine processes the actual copying operation based on the data output in step S3.

The subroutines for steps S6 to S8 are described below in detail.

Figure 13A:
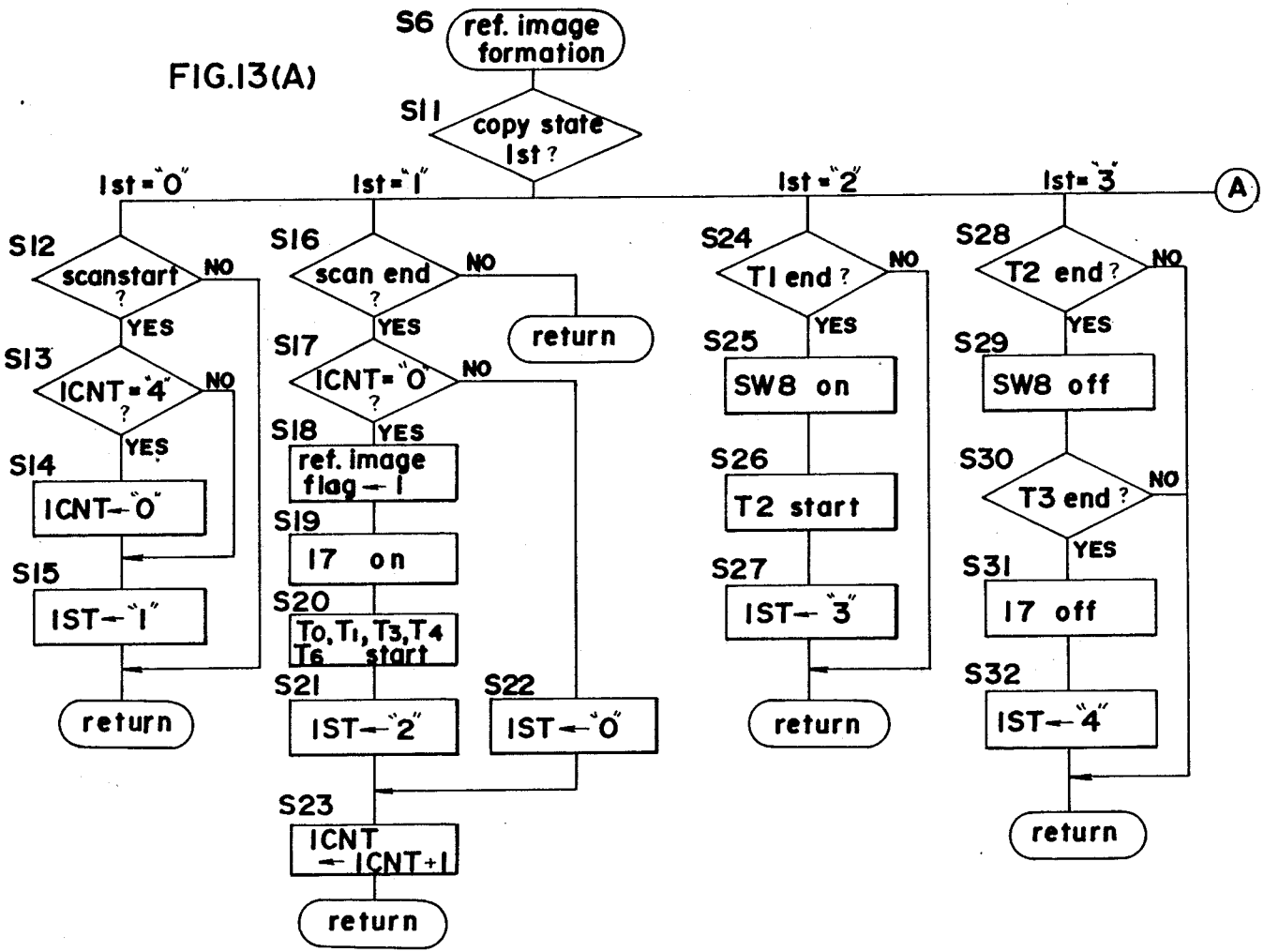
Figure 13:
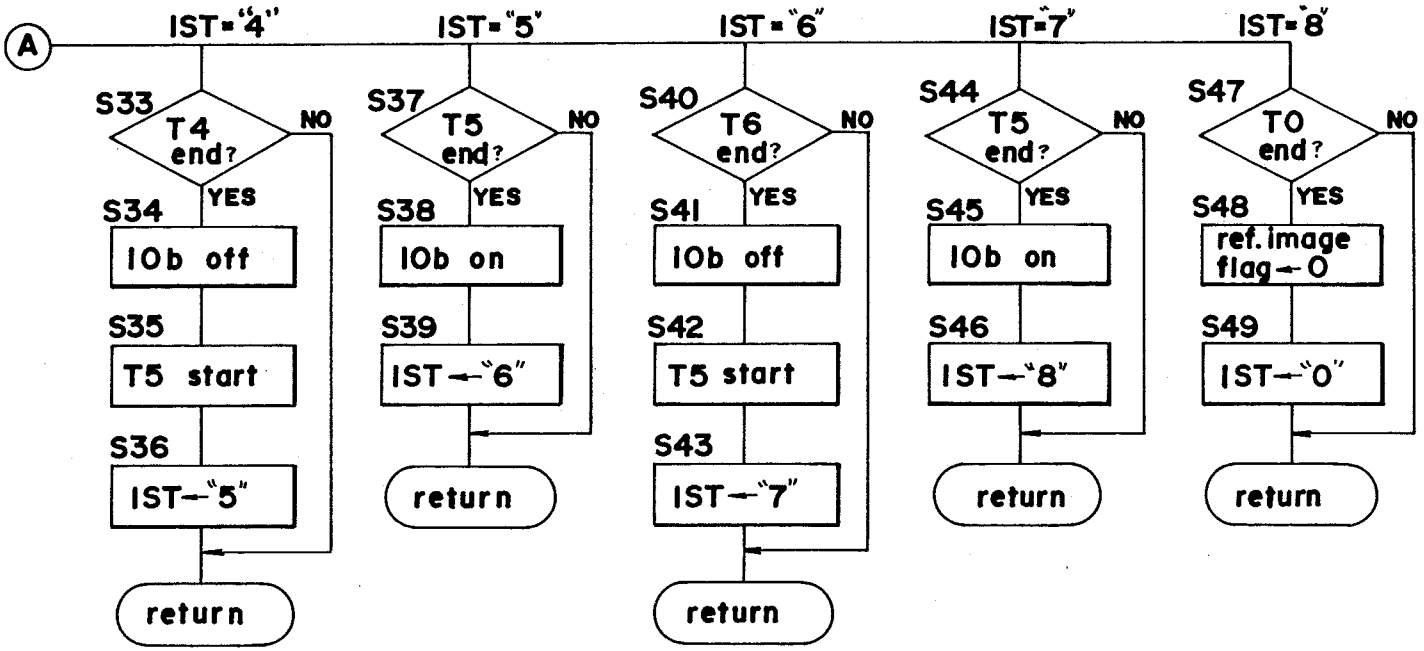

FIGS. 13A and 13B show the subroutine for reference latent image formation executed in step S6.

When this subroutine is called, the copy state IST is first checked in step S11. The copy state IST can hold nine values ranging from 0 to 8, which change as the copy operation progresses At initialization, the copy state IST is reset to 0 and the 0 routine is executed.

In step S12, a check is run to determine whether or not scanning of the original document has started. If scanning has not started, the program immediately returns to the main routine; if scanning has started, the counter ICNT is checked in step S13. The counter ICNT increments with the first copy operation, as described hereinafter. The counter ICNT is reset to 0 in step S14 only after it registers a value of 4. Further, when the counter ICNT registers a value other than 4, the copy state IST is set at 1 in step S15 and the program returns to the main routine. The formation of the reference latent images L1*a* and L1*b* is executed only when the counter ICNT is reset to 0, as described below, so as to be performed once every fourth copy operation.

After the copy state IST is set at 1 in the aforesaid step S15, the routine continues to subroutine 1 when this subroutine is called.

First, in step S16, a check is run to determine whether or not scanning of the original document has been completed. If scanning has not been completed, the subroutine immediately returns to the main routine if scanning has been completed, the counter ICNT is checked in step S17. The subroutine under step S18 is executed only when the counter ICNT registers 0. When the counter ICNT registers a value other than 0, the copy state IST is set to 0 in step S22, the counter ICNT is incremented in step S23, then the program returns to the main routine.

In step S18, the reference image formation flag indicating that the reference image formation mode is being executed is set at 1, and in step S19, the shutter 11 is actuated via current applied to solenoid 19 to interrupt the light B projected to the photosensitive drum 5. At the same time, in step S20, timers T0, T1, T3, T4 and T6 are started. Timer T0 is set so as to expire with a time lag t0 when the reference image formation flag is preset at 1, as shown in the time chart of FIG. 8. Timer T1 is set so as to expire with a time lag t1 which lasts until the mesh grid potential GVi is reduced to 500 V when the switch SW8 is switched ON. Timer T3 is set so as to expire with a time lag t3 during which current is applied to solenoid 17 and the projected light B is interrupted by shutter 11. Timer T4 is set so as to expire with a time lag t4 which covers from the shutter 11 operation until unexposed areas eraser 10 LED 10*b* is switched OFF for the formation of the first reference image L1*a*. Timer T6 is set so as to expire with a time lag t6 which lasts until the LED 10*b* is again switched OFF for the formation of the second reference image L1*b*.

Subsequently, in step S21, the copy state IST is set at 2, and in step S22, the counter ICNT is incremented, then the program returns to the main routine.

After the copy state IST is set at 2 in the aforesaid step S21, the routine continues to subroutine 2 when this subroutine is called.

In step S24, the status of the previously mentioned timer T1 is checked. When Timer T1 has not expired, the program immediately returns to the main routine. When timer T1 has expired, the charging to 600 V is completed for the formation of the first reference image L1*a*, switch SW8 is switched ON in step S25, and preparations made for the second image L1*b* formation. Next, in step S26, timer T2 is started. The timer T2 is set so as to expire with a time lag t2 so as to maintain switch S8 in the ON state as shown in FIG. 8. Subsequently, in step S27, the copy state IST is set at 3 and the program returns to the main routine.

After the copy state IST is set at 3 in the aforesaid step S27, the routine continues to subroutine 3 when this subroutine is called.

In step S28, the status of the aforesaid timer T2 is checked. When the timer T2 has not expired, the program immediatelY returns to the main routine; when the timer T2 has expired, charging to 500 V is completed for the formation of the second reference image L1*b*, then switch SW8 is switched OFF in step S29 Thereafter, in step S30, the status of the aforesaid timer T3 is checked. When timer T3 has not expired, the program returns to the main routine; when timer T3 has expired, then in step S31, the power supplied to solenoid 17 is stopped, and shutter 11 is removed from the optical path of light projected to the photosensitive drum 5. Subsequently, in step S32, the copy state IST is set at 4 and the program returns to the main routine.

After the copy state IST is set at 4 in the aforesaid step S32, the routine continues to subroutine 4 when this subroutine is called.

In step S33, the status of the aforesaid timer T4 is checked. When the timer T4 has not expired, the program immediately returns to the main routine; when timer T4 has expired, the unexposed areas eraser 10 LED 10*b* is switched OFF in step S34 for the formation of the first latent image L1*a*. At the same time, timer T5 is started in step S35. The timer T5 is set so as to expire with the OFF time t5 of LED 10*b* shown in the time chart of FIG. 8. Subsequently, in step S36, the copy state IST is set at 5 and the program returns to the main routine.

After the copy state IST is set at 5 in the aforesaid step S36, the routine continues to subroutine 5 when this subroutine is called.

In step S37, the status of the aforesaid timer T5 is checked. When timer T5 has expired, the program immediately returns to the main routine. When timer T5 has not expired, the unexposed areas eraser 10 LED 10*b* is switched ON in step S38 for formation of the first reference image L1*a*. Thereafter, in step S39, the copy state IST is set at 6 and the program returns to the main routine.

After the copy state IST is set at 6 in the aforesaid step S39, the routine continues to subroutine 6 when this subroutine is called.

In step S40, the status of the aforesaid timer T6 is checked. When timer T6 has not expired, the program immediately returns to the main routine. When timer T6 has expired, the unexposed areas eraser 10 LED 10*b* is switched OFF in step S41 for formation of the second reference image L1*b*. At the same time, the timer T5 is restarted in step S42. Thereafter; in step S43, the copy state IST is set at 7 and the program returns to the main routine.

After the copy state IST is set at 7 in the aforesaid step S43, the routine continues to subroutine 7 when this subroutine is called.

In step S44, the status of the aforesaid timer T5 is checked. When timer T5 has not expired, the program immediately returns to the main routine. When timer T5 has expired, the unexposed areas eraser 10 LED 10*b* is switched ON in step S45 to form the second reference image L1*b*. Then, in step S46, the copy state IST is set at 8 and the program returns to the main routine.

After the copy state IST is set at 8 in the aforesaid step S46, the routine continues to subroutine 8 when this subroutine is called.

In step S47, the status of the aforesaid timer T0 is checked. When timer T0 has not expired, the program immediately returns to the main routine. When timer T0 has expired, the reference image formation flag is reset to 0 in step S48. Then, in step S49, the copy state IST is reset to 0 and the program returns to the main routine Then, when this subroutine is called, the copy state IST is checked in step S11, the routine continues to subroutine 0, and thereafter the previously described operations are repeated to form the first and second reference images L1*a* and L1*b* once every four copy operations.

Figure 14A:
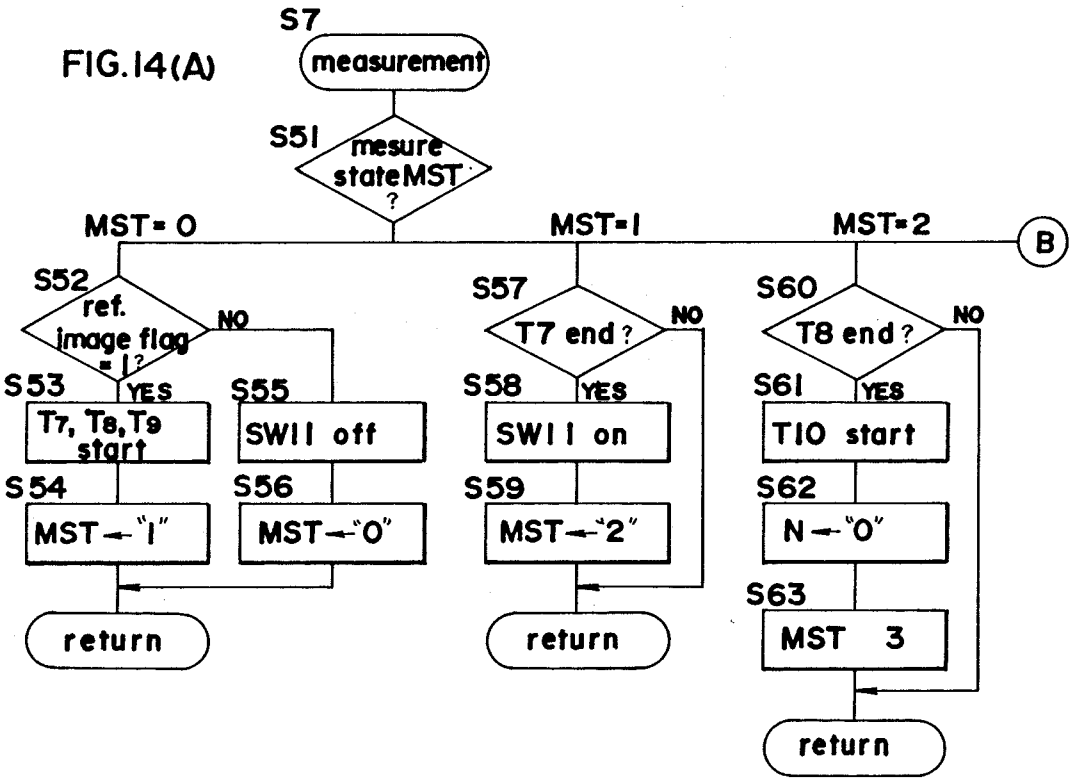
Figure 14B:
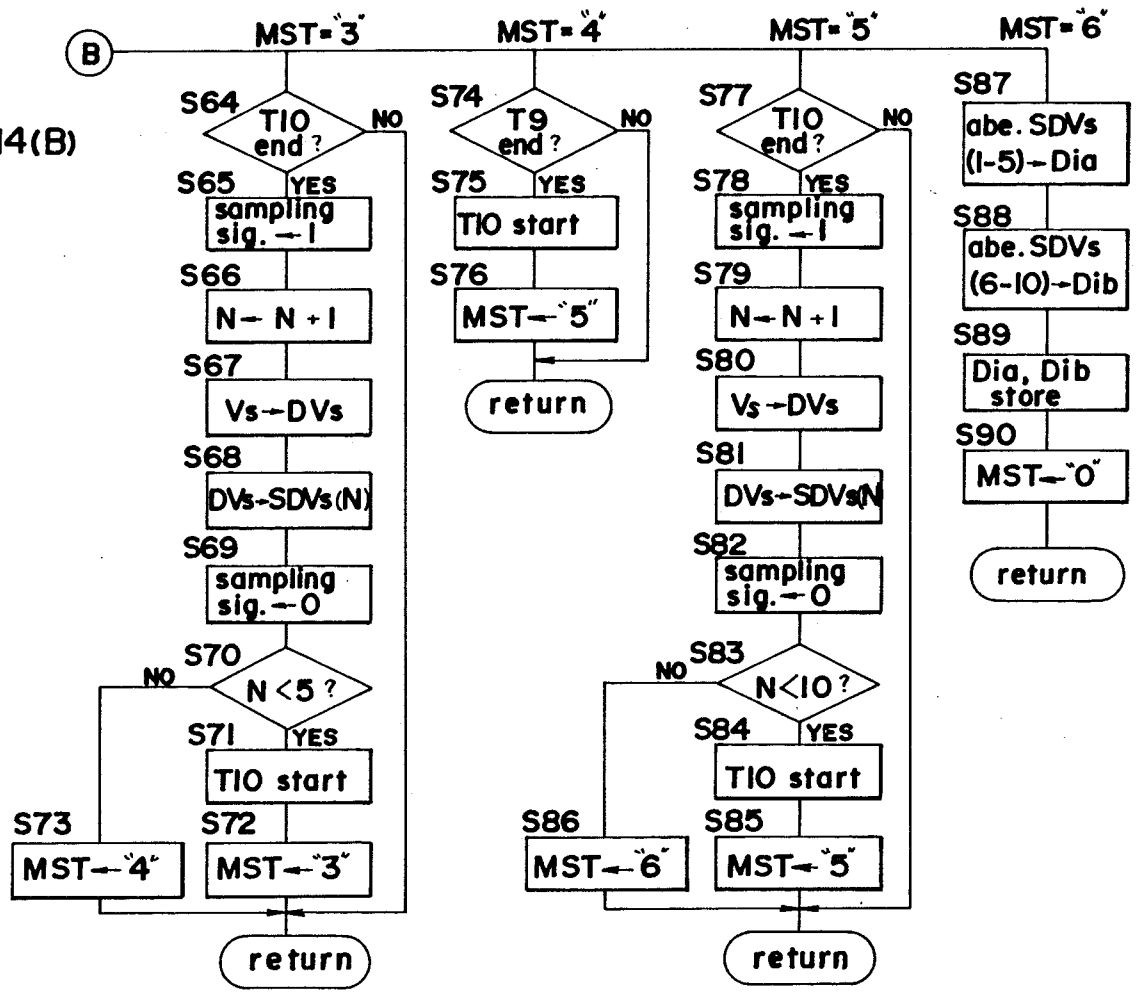

FIGS. 14A and 14B show the subroutines for the measurement of reflected light executed in step S7 of the main routine.

When this subroutine is called, the measure state MST is first checked in step S51. The measure state MST can hold seven values ranging from 0 to 6, and varies in accordance with the progress of the copy operation. The measure state MST is reset to 0 at initialization, and the subroutine 0 is executed first.

In step S52, the reference image formation flag is checked to determine whether or not it registers 1. When said flag registers 1, i.e., when the reference images L1*a* and L1*b* formation process is on-going, the timers T7, T8 and T9 are are started in step S53. The timer T7 is set so as to expire with a time lag t7 lasting until the switch SW11 is switched ON, i.e., until the photosensor 19 operation begins, as shown in FIG. 8. The timers T8 and T9 are set so as to expire with time lags t8 and t9 respectively, to measure the stable region of photosensor 19 output voltage Vs based on the quantity of reflected light from the first and second reference toner images L2*a* and L2*b* respectively. Subsequently, in step S54, the measure state MST is set at 1 and the program returns to the main routine.

When the it is determined that the reference image formation flag is 0 in the aforesaid step S52, the switch SW11 is switched OFF in step S55, and in step S56, the measure state MST is reset to 0 and then the program returns to the main routine.

After the measure state MST is set at 1 in the aforesaid step S54, the routine continues to subroutine 1 when this subroutine is called.

In step S57, the status of the aforesaid timer T7 is checked. When timer T7 has not expired, the program immediately returns to the main routine. When timer T1 has expired, the switch SW11 is switched ON and the light emitter 19*a* of photosensor 19 is switched ON in step S58 to prepare for the measurement of the first reference toner image L2*a* density. Subsequently, in step S59, the measure state MST is set at 2 and the program returns to the main routine.

After the measure state MST is set at 2 in the aforesaid step S59, the routine continues to subroutine 2 when this subroutine is called.

In step S60, the aforesaid timer T8 status is first checked. When timer T8 has not expired, the program returns to the main routine. When timer T8 has expired, the timer T10 is started in step S61. The timer T10 is set so as to expire with the sampling time t10 as shown in FIG. 8 Continuing, the counter N is reset to 0 in step S62 Counter N is used to sample the photosensor 19 output voltage Vs at the stable region five times. Thereafter, in step S63, the measure state MST is set at 3 and the program returns to the main routine After the measure state MST is set at 3 in the aforesaid step S63, the routine continues to subroutine 3 when this subroutine is called. At this step the density of the first reference toner image L2*a* is measured five times by the photosensor 19. T10 is In step S64, the status of the aforesaid timer first checked. When timer T10 has not expired, the program immediately returns to the main routine. When timer T10 has expired, then in step S65, the sample timing signal is set at 1, and in step S66, the counter N is incremented by 1. Continuing to step S67, the output voltages Vs from photoreceptor 19*b* are converted (A/D) to digital signals DVs and are stored in RAM 202 as voltage signals SDVs(N) in step S68. The sample timing signal is reset to 0 in step S69.

Next, in step S70, the status of counter N is checked, and when said counter does not register 5, the timer T10 is started in step S71, then in step S72, the measure state MST is set at 3 and the program returns to the main routine. That is to say, until counter N registers 5, the voltage signal SDVs(N) is sampled five times, and the voltage signals stored in RAM 202 in step S68 include five data from SDVs(1) to SDVs(5).

When the five samples are run and it is determined that the counter N has expired to 5 in step S70, then the measure state MST is set at 4 in step S73 and the program returns to the main routine.

After the measure state MST is set at 4 in the aforesaid step S73, the routine continues to subroutine 4 when this subroutine is called.

In step S74, the status of the aforesaid timer T9 is checked. When timer T9 has not expired, the program returns immediately to the main routine. When timer T9 has expired, the timer T10 is started in step S75, and in step S76 the measure state MST is set at 5, then the program returns to the main routine.

After the measure state MST is set at 5 in the aforesaid step S76, the routine continues to subroutine 5 when this subroutine is called.

At this point the density of the second reference toner image L2*b* is sampled five times by photosensor 19. Then each of the steps S77 to S82 proceed in the same manner as the previouslY described steps S64 to S69 The counter N is incremented continuously from step S66 until it is determined to register 10 in step S83, and until said determination the steps S84, S85, S77 to S83 are repeated. That is to say, sampling of the five voltage signals SDVs(N) continues until the counter N is registers 10, and the voltage signals stored in RAM 202 in step S81 include five data from SDVs(6) to SDVs(10). Then, when it is determined that counter N has incremented to 10, the measure state MST is set at 6 in step S86 and the program returns to the main routine.

After the measure state MST is set at 6 in the aforesaid step S86, the routine continues to subroutine 6 when this subroutine is called.

In step S87, the average value of the first reference toner image L2*a* voltage signals SDVs(1) to SDVs(5) stored in RAM 202 in step S87 is calculated and the sampling data Dia are obtained. At the same time, the average value of the second reference toner image L2*b* voltage signals SDVs(6) to SDVs(10) stored in RAM 202 in step S88 is calculated and sampling data Dib are obtained. Next, in step S89, the sampling data Dia and Dib are stored in RAM 202, the measure state MST is reset to 0 and this subroutine is completed.

Figure 15:
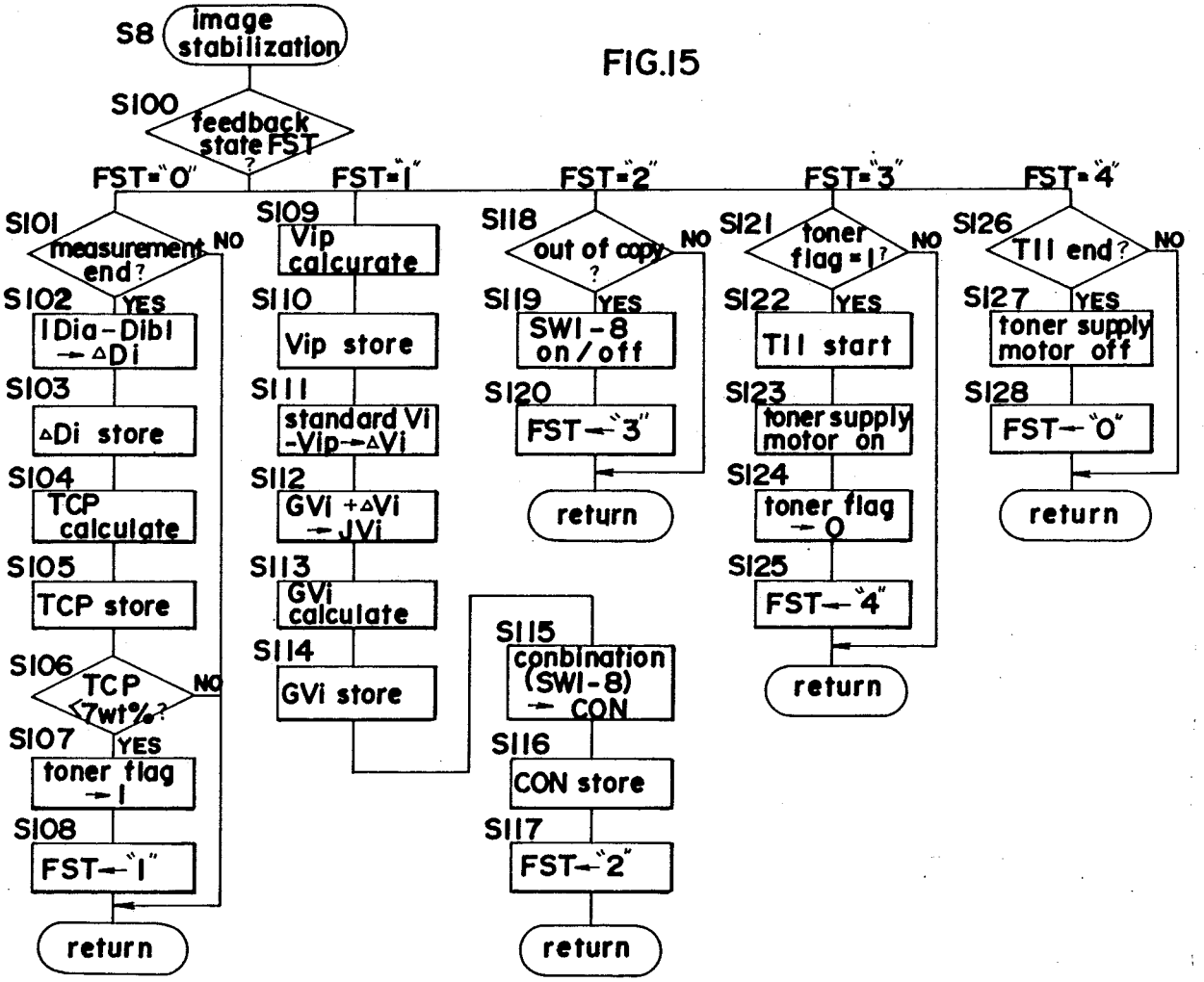

FIG. 15 shows the image stabilization subroutine executed in step S8 of the main routine.

When this subroutine is called, the feedback state FST is first checked in step S100. The feedback state FST can hold five values from 0 to 4 and varies in accordance with the progress of the copy operation. At initialization, the feedback state FST is set at 0 and the first routine 0 is started. At this point a determination is made as to whether or not to replenish the toner.

First, in step S101, a determination is made as to whether or not the reflected light measurements via photosensor 19 have been completed for the first and second reference toner images L2*a* and L2*b*. If said measurements have not been completed, the program immediately returns to the main routine. If said measurements have been completed, then the absolute value of the difference between the previously described sampling data Dia and Dib is calculated in step S102 and designated the output difference ΔDi which is then stored in RAM 202 in step S103.

Next, in step S104, the developer toner concentration detection value TCP during the aforesaid measurements is calculated using the output differential ΔDi, and stored in RAM 202 in step S105. The relationship between the developer toner concentration T/C and the output differential ΔDi is input to the CPU 201 beforehand based on the information in FIG. 11.

Subsequently, in step S106, a comparison is made of the toner detection value TCP and the standard toner concentration of 7% by weight. When the detection value TCP is greater than 7% by weight, the program returns to the main routine without prompting toner replenishment; if the detection value TCP is less than 7% by weight, the toner resupply flag is set at 1 in step S107, and toner replenishment is prompted. Thereafter, in step S108, the feedback state is set at 1 and the program returns to the main routine After the feedback state FST is set at 1 in the aforesaid step S108, the routine continues to subroutine 1 when this subroutine is called. At this point the output value of the sensitizing charger 6 is determined.

First, in step S109, the surface potential ViP of the photosensitive member in the developing region X3 is calculated based on the toner detection value TCP and the first reference image L2*a* sampling data, then in step S110, said surface potential ViP is stored in RAM 202.

Next, in step S111, the difference ΔVi between the standard potential and the detection value ViP is calculated, the deviation score ΔVi added to the grid potential GVi in step S112, and the correction value JVi is then calculated Continuing to step S113, the grid potential GVi is calculated from the correction value JVi, then the grid potential GVi is stored in RAM 202 in step S114.

Subsequently, in step S115, the combined data CON for the short circuit switches SW1 to SW8 are calculated to obtain the previously calculated grid potential GVi, said combined data CON is then stored in RAM 202 in step S116. Thereafter, in step S117, the feedback state FST is set at 2 and the program returns to the main routine After the feedback state FST is set at 2 in the aforesaid step S117, the routine continues to subroutine 2 when this subroutine is called.

In step S118, the copy operation is first checked and a determination is made as to whether or not image formation is in progress When image formation is in progress, the program immediately returns to the main routine When image formation is not in progress, the short circuit switches SW1 to SW8 calculated in the previous step S115 are commanded ON and OFF so as to achieve a specified grid potential GVi in step S119. Then, in step S110, the feedback state FST is set at 3 and the program returns to the main routine After the feedback state FST is set at 3 in the aforesaid step S120, the routine continues to subroutine 3 when this subroutine is called.

In step S121, a determination is made as to whether or not the toner resupply flag is set at 1. When the flag is set at 0, the program immediately returns to the main routine. When the flag is set at 1, i.e. when toner replenishment is indicated, the timer T11 is started in step S122. The timer T11 is set so as to expire with time lag t11 during which the toner resupply motor is started. In step S123, the toner resupply motor 78 is switched ON, and in step S124 the toner resupply flag is reset to 0. Thereafter, in step S125, the feedback state FST is set at 4 and the program returns to the main routine.

After the feedback state FST is set at 4 in the aforesaid step S125, the routine continues to subroutine 4 when this subroutine is called.

In step S126, the status of the aforesaid timer T11 is checked. When timer T11 has not expired, the program returns to the main routine. When timer T11 has expired, the toner resupply motor 78 is switched OFF in step S127. Thus, a specified quantity if toner from toner tank 76 is supplied to the developer. Then, in step S128, the feedback state is reset to 0 and the program returns to the main routine.

Other Embodiments

The electrophotographic copying apparatus of the present invention is not limited in application to the aforesaid embodiment, but rather then substance of the invention can be realized in various modifications within the scope claimed herein.

More specifically, the aforesaid embodiment of the invention may vary the output of the sensitizing charger 6 so as to vary the densities of the two reference toner images L2*a* and L2*b*, and the developing bias voltage which is applied to the developing sleeve 71 may also be varied. In the present invention, the difference in potential between the reference electrostatic latent images L1*a*, L1*b* and the developing sleeve 71 may be changed to change the densities of the reference toner images L2*a* and L2*b*.

Further, the reference latent images L1*a* and L1*b* may be formed by a method other than the use in combination of the unexposed areas eraser 10 and the shutter 11, said other method involving the arrangement of a black reference pattern on the inner surface of the original document glass platen 1 in the upstream scan direction, said reference pattern region being exposed to the unexposed area of the photosensitive drum 5.

In addition, a sensitizing charger other than the scorotron type may be used, such as a corotron type which lacks the grid"63 In such a case, correction of the charging potential may be accomplished by controlling the output current of the high-voltage transformer 62.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein

What is claimed:

1. An electrophotographic copying apparatus comprising:

a photosensitive member;

charging means for charging the surface of said photosensitive member;

exposure means for exposing the charged surface of said photosensitive member to light so as to form an electrostatic latent image thereon;

developing means for developing the electrostatic latent image by a developer incorporating toner and carrier;

means for forming two reference toner images having different electric potential on the surface of said photosensitive member by operating said charging means under different conditions so as to cause the two reference toner images to have different densities;

measuring means for optically measuring the densities of the two reference tones images formed on the surface of said photosensitive member;

detecting means for detecting toner concentration in the developer based on the difference of the two reference toner image densities measured by said measuring means; and supply means for supplying toner to the developer when the toner concentration detected by said detecting means is less than a specified value.

2. An electrophotographic copying apparatus as claimed in claim 1, wherein said reference toner image forming means is operable to change the electric potential of the surface of said photosensitive member between the two reference toner images.

3. An electrophotographic copying apparatus as claimed in claim 1, wherein said detecting means detects the toner concentration in the developer based on the balance of the two reference toner image densities.

4. An electrophotographic copying apparatus as claimed in claim 1, wherein said measuring means measures each density of the one reference toner image several times and designates the averaged value as the density of one.

5. An electrophotographic copying apparatus as claimed in claim 1, wherein said reference toner image forming means is operable to change the developing bias voltage applied to said developing means between the two reference toner images.

6. An electrophotographic copying apparatus comprising:

a photosensitive member;

charging means for charging the surface of said photosensitive member;

exposure means for exposing the charged surface of said photosensitive member to light so as to form an electrostatic latent image thereon;

developing means for developing the electrostatic latent image by a developer incorporating toner and carrier;

means for forming a first reference toner image on the surface of said photosensitive member by operating said charging means under normal image formation condition and for forming a second reference toner image on the surface of said photosensitive member by operating said charging means under abnormal image formation condition;

measuring means for optically measuring the densities of the first and second reference toner images formed on the surface of said photosensitive member;

detecting means for detecting toner concentration in the developer based on the difference of the first and second reference toner image densities measured by said measuring means;

means for determining the charging potential of the photosensitive member surface, in the normal image formation under which the first reference toner image is formed, based on the toner concentration in the developer detected by said detecting means and the first reference toner image density measured by said measuring means; and means for correcting the normal image formation condition in accordance with the surface potential determined by said determining means.

7. An electrophotographic copying apparatus as claimed in claim 6, wherein said reference toner image forming means is operable to change the electric potential of the surface of said photosensitive member between the first and second reference toner images.

8. An electrophotographic copying apparatus as claimed in claim 7, wherein said correcting means corrects the charging potential of the photosensitive member in the normal image formation.

9. An electrophotographic copying apparatus as claimed in claim 8, further comprising memory means for storing data representing the charging potential of the photosensitive member in the normal image formation, wherein the first reference toner image is formed based on the data stored in the memory means and said correcting means corrects the data so as to obtain a desired potential in the next image formation.

10. An electrophotographic copying apparatus as claimed in claim 6, wherein said detecting means detects the toner concentration in the developer based on the balance of the first and second reference toner image densities.

11. An electrophotographic copying apparatus as claimed in claim 6, wherein said measuring means measures each density of the one reference toner image several times and designates the averaged value as the density of one.

12. An electrophotographic copying apparatus comprising:

a photosensitive member;

charging means for charging the surface of said photosensitive member;

exposure means for exposing the charged surface of said photosensitive member to light so as to form an electrostatic latent image thereon;

developing means for developing the electrostatic latent image by a developer incorporating toner and carrier;

means for forming a first reference toner image on the surface of said photosensitive member by operating said charging means under normal image formation condition and for forming a second reference toner image on the surface of said photosensitive member by operating said charging means under abnormal image formation condition;

measuring means for optically measuring the densities of the first and second reference toner images formed on the surface of said photosensitive member;

detecting means for detecting, toner concentration in the developer based on the difference of the first and second reference toner image densities measured by said measuring means;

supply means for supplying toner to the developer when the toner concentration detected by said detecting means is less than a specified value;

means for determining the charging potential of the photosensitive member surface, in the normal image formation condition under which the first reference toner image is formed, based on the toner concentration in the developer detected by said detecting means and the first reference toner image density measured by said measuring means; and means for correcting the charging potential of the photosensitive member surface in the normal image formation condition in accordance with the surface potential determined by said determining means.

13. An electrophotographic copying apparatus as claimed in claim 12, wherein said reference toner image forming means is operable to change the electric potential of the surface of said photosensitive member between the first and second reference toner images.

14. An electrophotographic copying apparatus as claimed in claim 13, further comprising memory means for storing data representing the charging potential of the photosensitive member in the normal image formation condition, wherein the first reference image is formed based on the data stored in the memory means and said correcting means corrects the data so as to obtain a desired potential in the next image formation.

15. An electrophotographic copying apparatus as claimed in claim 12, said detecting means detects the toner concentration in the developer based on the balance of the first and second reference toner image densities.

16. An electrophotographic copying apparatus as claimed in claim 12, wherein said measuring means measures each density of the one reference toner image several times and designates the averaged value as the density of one.

* * * * *